US012270421B2

(12) United States Patent
White et al.

(10) Patent No.: US 12,270,421 B2
(45) Date of Patent: Apr. 8, 2025

(54) SMART VACUUM PRIMING SYSTEM

(71) Applicant: Cornell Pump Company LLC, Clackamas, OR (US)

(72) Inventors: Jordan R. White, Canby, OR (US); Brandon Yoder, Parma, ID (US); Andrew Enterline, Troutdale, OR (US)

(73) Assignee: Cornell Pump Company LLC, Clackamas, OR (US)

( * ) Notice: Subject to any disclaimer, the term of this patent is extended or adjusted under 35 U.S.C. 154(b) by 0 days.

(21) Appl. No.: 18/441,219

(22) Filed: Feb. 14, 2024

(65) Prior Publication Data

US 2024/0280107 A1 Aug. 22, 2024

Related U.S. Application Data

(60) Provisional application No. 63/486,088, filed on Feb. 21, 2023.

(51) Int. Cl.
*F04D 9/04* (2006.01)

(52) U.S. Cl.
CPC ..... *F04D 9/041* (2013.01); *F04D 9/048* (2013.01)

(58) Field of Classification Search
CPC ..... F04D 9/041; F04D 9/042; F04D 9/044; F04D 9/045; F04D 9/046; F04D 9/048
See application file for complete search history.

(56) References Cited

U.S. PATENT DOCUMENTS 2,412,839 A 12/1946 Lamar
2,464,144 A 3/1949 McConaghy
(Continued)

FOREIGN PATENT DOCUMENTS

CN 202203121 U 4/2012
CN 107588009 A * 1/2018
(Continued)

OTHER PUBLICATIONS

Machine translation of CN 107588009 (Year: 2018).*
(Continued)

*Primary Examiner* — David E Sosnowski
*Assistant Examiner* — John G Davis
(74) *Attorney, Agent, or Firm* — Snyder, Clark, Lesch & Chung, LLP

(57) ABSTRACT

Systems and methods described herein provide a smart vacuum priming system for centrifugal pumps. The vacuum priming system includes a vacuum pump, a suction assembly, an electromagnetic clutch assembly, and a pressure sensor. The suction assembly provides fluid communication between the vacuum pump and a float box of the centrifugal pump. The electromagnetic clutch assembly selectively engages the vacuum pump, such that a drive shaft of the centrifugal pump also powers the vacuum pump when the clutch is on. The pressure sensor indicates when the centrifugal pump is in a primed state based on a discharge pressure of the centrifugal pump. When the pressure sensor indicates the main pump is in the primed state, the electromagnetic clutch decouples the vacuum pump from the drive shaft. When the pressure sensor indicates the main pump is not in the primed state, the electromagnetic clutch couples the vacuum pump to the drive shaft.

20 Claims, 8 Drawing Sheets

(56) References Cited

U.S. PATENT DOCUMENTS

| | | | | |
|---|---|---|---|---|
| 6,783,330 | B2 * | 8/2004 | Carnes | F04D 9/043 137/434 |
| 9,587,641 | B2 | 3/2017 | Mettler et al. | |
| 2013/0272843 | A1 | 10/2013 | Mettler et al. | |
| 2020/0158115 | A1 | 5/2020 | Mei | |

FOREIGN PATENT DOCUMENTS

| | | | | |
|---|---|---|---|---|
| GB | 2541194 | A | | 2/2017 |
| JP | H06-200893 | A | * | 7/1994 |
| JP | 2013148099 | A | | 8/2013 |
| NL | 1016113 | C2 | | 3/2002 |

OTHER PUBLICATIONS

Machine translation of JP H06-200893 (Year: 1994).*
International Search Report issued in corresponding International Application No. PCT/US2024/015686, mailed May 27, 2024, 9 pages.

* cited by examiner

SMART VACUUM PRIMING SYSTEM

CROSS-REFERENCE TO RELATED APPLICATION

This application claims priority under 35 U.S.C. § 119, based on U.S. Provisional Patent Application No. 63/486,088, filed Feb. 21, 2023, titled "Smart Vacuum Priming System," the disclosure of which is hereby incorporated by reference.

BACKGROUND OF THE INVENTION

Centrifugal pumps are commonly used for moving liquids for irrigation, domestic water systems, and many other applications. Liquid is typically urged through the pump by a spinning disk-shaped impeller positioned inside an annular volute. The volute typically has an eye at the center where water enters the pump and is directed into the center of the impeller. The rotation of the impeller slings the liquid outward to the perimeter of the impeller where it is collected for tangential discharge. As the liquid is driven outwardly, a vacuum is created at the eye, which tends to draw more fluid into the pump.

One of the basic limitations on the use of centrifugal pumps is their limited ability to draw fluid for priming when starting from an air-filled or dry condition. The impeller, which is designed to pump liquids, often cannot generate sufficient vacuum when operating in air to draw liquid up to the pump when the standing level of the liquid is below the eye of the pump. Thus, in some applications, to begin pumping, the pump must first self-prime by drawing water up to the pump from a low water level. An auxiliary vacuum pump may be included with the centrifugal pump for this purpose. The vacuum pump serves to evacuate air from the suction line, priming the centrifugal pump and allowing the system to commence pumping.

DETAILED DESCRIPTION

Figure 1:
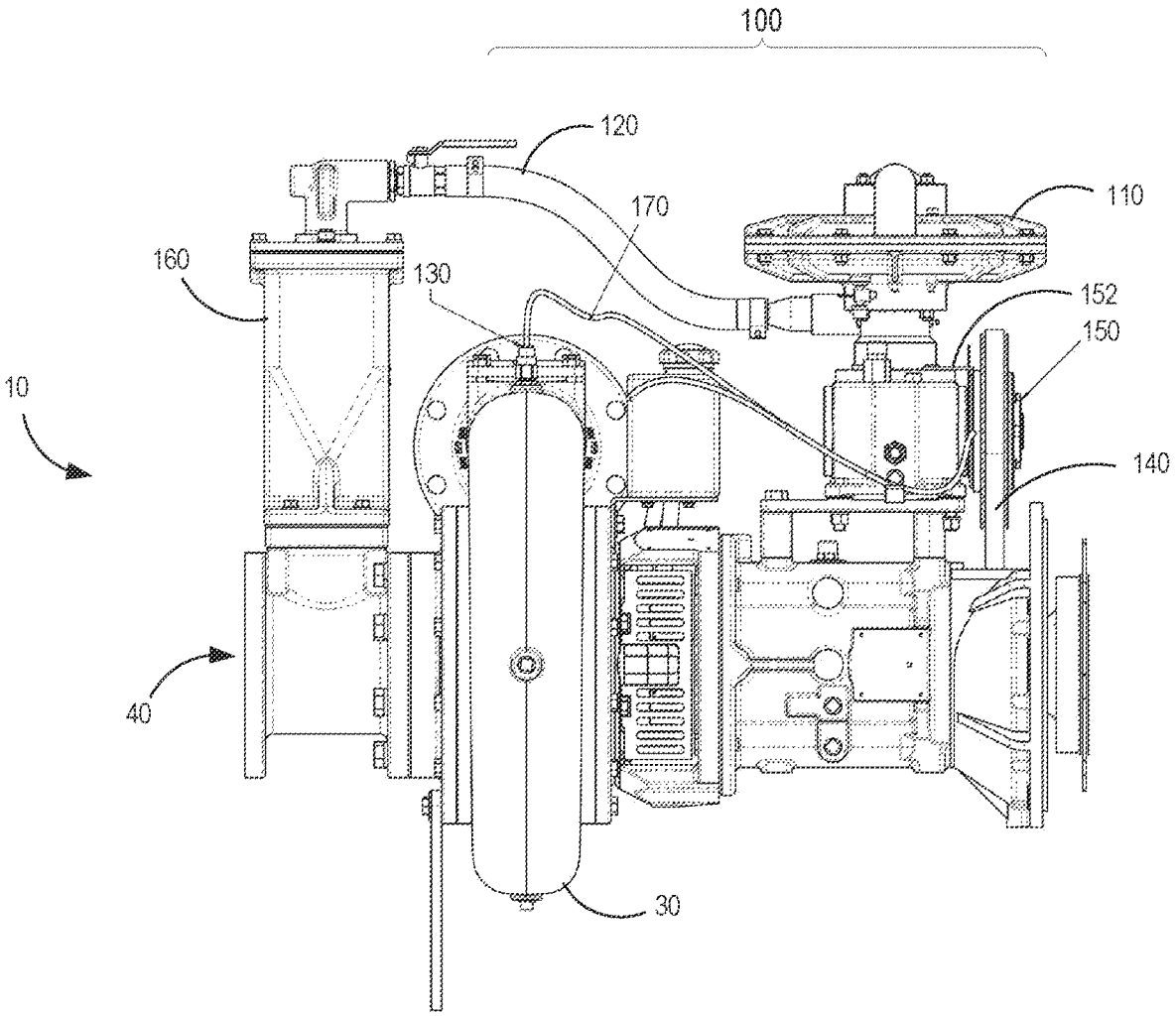
FIG. 1 is a side view of pump assembly including a smart vacuum priming system, according to an implementation described herein.

The following detailed description refers to the accompanying drawings. The same reference numbers in different drawings may identify the same or similar elements. Also, the following detailed description does not limit the invention.

Centrifugal pumps equipped with self-priming systems typically use a vacuum pump to evacuate air from a suction line, allowing the system to beginning pumping. In self-priming systems, the vacuum pump is typically driven continuously from the same drive shaft used by the centrifugal pump. However, the vacuum pump serves only to prime the system. Once the system is primed, air flow (suction) to the centrifugal pump's impellers is shut off (e.g., via a float valve). Henceforth, in these systems, the vacuum pump pulls a vacuum against a closed valve (e.g., a dead head condition).

Under typical operating conditions with self-priming pumps, over 80% of a vacuum pump's run time may be in this dead head condition, which reduces overall system efficiency, causes unnecessary wear on the diaphragm inside the vacuum pump, and leads to premature failure of elastomeric components in the vacuum pump. Furthermore, if the float valve becomes stuck in an open position or otherwise permits leakage, the continuously running vacuum pump may suction liquid and damage the vacuum pump.

A clutch may be connected in self-priming systems to selectively engage/disengage the vacuum pump from the drive shaft. Previous systems to selectively engage/disengage the vacuum pump have been subject to excessive clutch cycling, which can lead to premature clutch and/or belt failures. Hysteresis settings (e.g., associated with a float valve position) to prevent this unwanted cycling complicate system designs and have generally proved to be ineffective.

Thus, there remains a need for a self-priming pump system that can overcome problems of prior self-priming pumps. Particularly, a self-priming pump system is needed to selectively disengage the vacuum pump when priming is not required, prevent liquid suction into the vacuum pump in the event of a float valve failure, and minimize clutch cycling.

Systems and methods described herein provide a self-priming pump system with an electromagnetic clutch that disengages a vacuum pump once a centrifugal pump is primed. A priming state is detected by use of a sensor. The sensor may include, for example, a pressure sensor that detects positive head generated by the centrifugal pump. When the centrifugal pump (also referred to as the main pump) is primed and generating discharge pressure, the electromagnetic clutch is disengaged via a relay and the vacuum pump does not operate. When the centrifugal pump is not primed and not generating discharge pressure, the clutch is engaged via a power supply and relay. When engaged, power is transmitted/supplied via a belt driven from the main pump shaft through the clutch to the vacuum pump shaft. If the main pump loses prime, the sensor detects the change in prime state (e.g., loss of discharge pressure), engages the clutch, and re-primes the system as needed.

According to an implementation, a smart vacuum priming system is provided for centrifugal pumps. The vacuum priming system includes a vacuum pump, a suction assembly, an electromagnetic clutch assembly, and a pressure sensor. The suction assembly provides fluid communication between the vacuum pump and a float box of the centrifugal pump. The electromagnetic clutch assembly selectively engages the vacuum pump, such that a drive shaft of the centrifugal pump also powers the vacuum pump when the clutch is on. The pressure sensor indicates when the centrifugal pump is in a primed state based on a discharge pressure. When the pressure sensor indicates the main pump is in the primed state, the electromagnetic clutch decouples the vacuum pump from the drive shaft. When the pressure sensor indicates the main pump is not in the primed state, the electromagnetic clutch couples the vacuum pump to the drive shaft.

According to another implementation, a self-priming centrifugal pump is provided. The centrifugal pump includes a volute housing an impeller; a drive shaft for the impeller; a float box; and a priming system. The priming system includes a vacuum pump, a suction assembly providing fluid communication between the vacuum pump and the float box, an electromagnetic clutch assembly, and a pressure sensor. The electromagnetic clutch assembly is configured to selectively run the vacuum pump, such that the drive shaft powers the vacuum pump when the clutch is engaged. The pressure sensor is configured to indicate, based on a discharge pressure in the volute, when the centrifugal pump is in a primed state. When the pressure sensor indicates the centrifugal pump is in the primed state, the electromagnetic clutch decouples the vacuum pump from the drive shaft to prevent suction through the suction assembly. When the pressure sensor indicates the centrifugal pump is not in the primed state, the electromagnetic clutch couples the vacuum pump to the drive shaft to permit suction through the suction assembly and prime the centrifugal pump.

Figure 2:
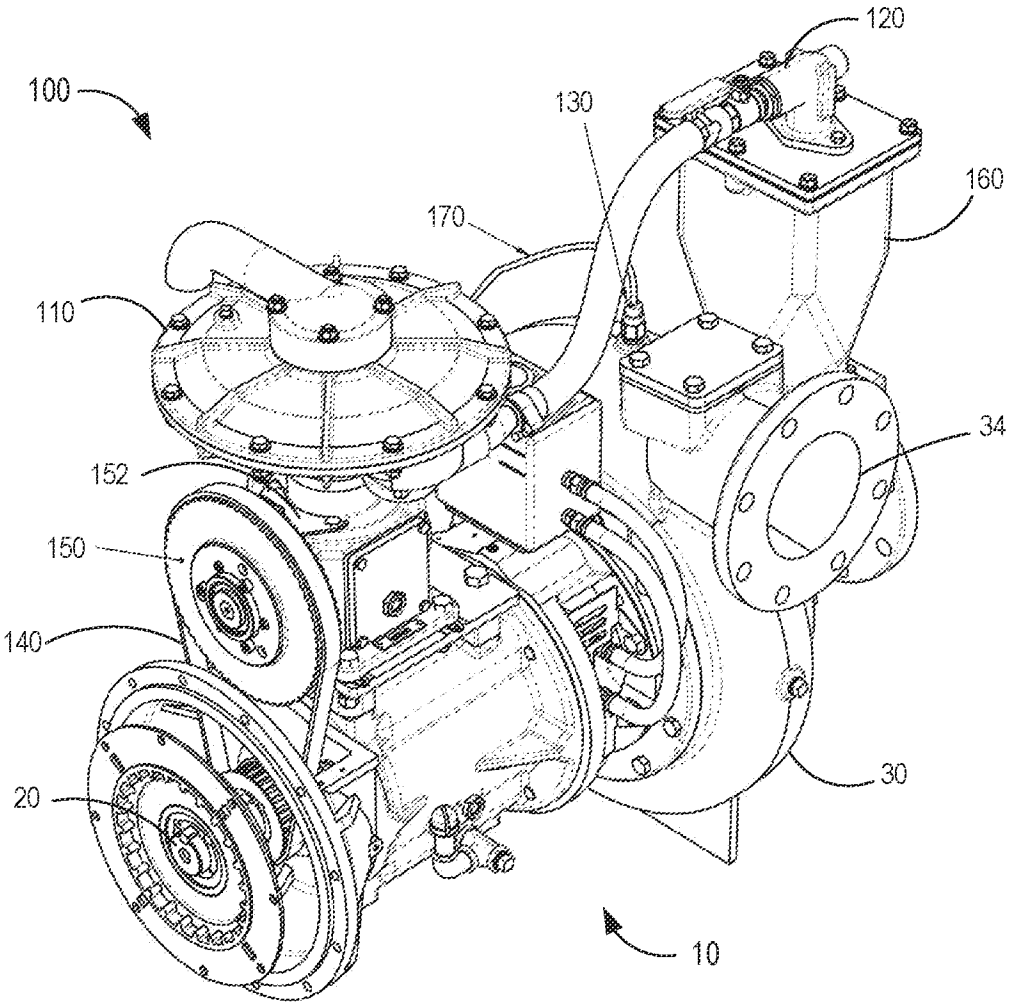
FIG. 2 is a perspective view of the assembly of FIG. 1.
Figure 3:
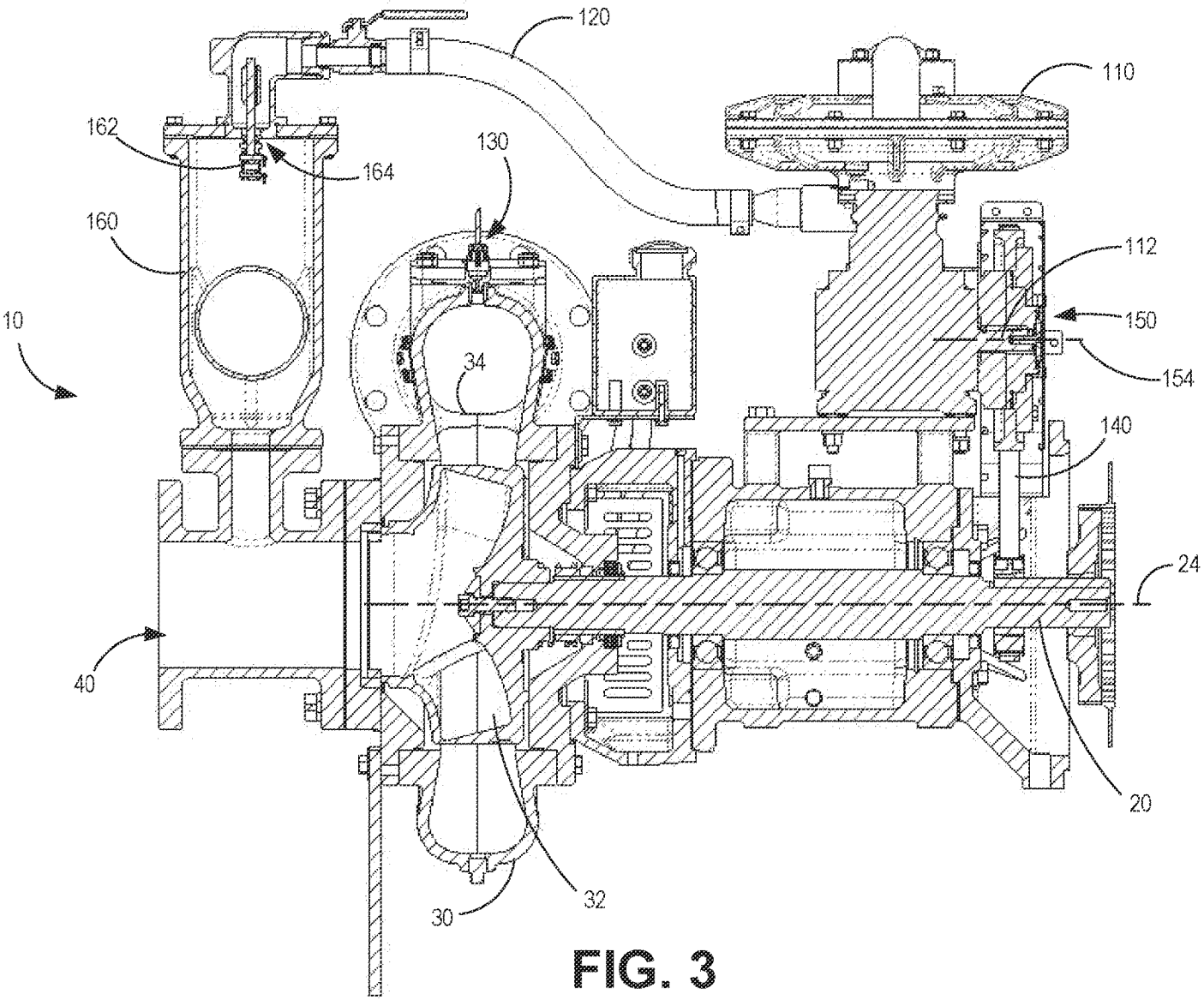
FIG. 3 is a side cross-section view of a pump assembly including a smart vacuum priming system.

FIG. 1 is a side view of a smart vacuum priming system 100, according to an implementation described herein, connected to a centrifugal pump 10. FIGS. 2 and 3 are perspective and cross-section views of centrifugal pump 10 with smart vacuum priming system 100.

Referring collectively to FIGS. 1-3, centrifugal pump 10 may include a drive shaft 20 that drives an impeller 32 within a volute 30. Volute 30 defines a chamber within that scrolls out to a discharge port 32. Impeller 32 concentrically sits in volute 30 and rotates therein. Drive shaft 20 may be connected to a motor (not shown) and spin impeller 32 around a common axis of drive shaft 20 and impeller 32. In operation, impeller 32 is rotated by the pump motor to induce a pumping action. The pumping action pulls liquid or slurry into an inlet pipe 40, through impeller 32, and out the volute discharge port 34. While centrifugal pump 10 can efficiently pump water or other liquids, it will not draw significant vacuum when operated dry. Instead, when centrifugal pump 10 is dry, priming may be accomplished with smart vacuum priming system 100.

Smart vacuum priming system 100 may include a vacuum pump 110, a suction assembly 120, a pressure sensor 130, a drive belt 140, a clutch 150, a float box 160, and a wire harness 170.

Vacuum pump 110 may include a positive displacement-type pump that is configured to draw a vacuum. Vacuum pump 110 may be mounted to centrifugal pump 10. For example, vacuum pump 110 may be attached to a platform that is secured to a bearing frame of centrifugal pump 10. Vacuum pump 110 may include a shaft 112 that drives vanes in vacuum pump 10 to generate suction through suction assembly 120.

Float box 160 may be mounted to inlet pipe 40 and in fluid communication with inlet pipe 40. Float box 160 may also include a suction port 164 for suction assembly 120. When vacuum pump 110 is functioning, vacuum pump 110 will evacuate air from inlet pipe 40 via suction assembly 120 and float box 160. As the air is removed from float box 160, liquid will begin to fill float box 160. As the liquid level increases in float box 160, a float valve 162 in the float box 160 will rise with the liquid level until the float valve 162 eventually closes off suction port 164. At this point, vacuum pump 110 will pull a vacuum against a closed valve (e.g., a dead head condition).

Suction assembly 120 may include may connect vacuum pump 110 to float box 160. When vacuum pump 110 is engaged/operating, vacuum pump 110 may provide suction through suction assembly 120 and float box 160 to evacuate air and draw liquid (e.g., water) into volute 30 of centrifugal pump 10 for priming.

Drive belt 140 may be connected to drive shaft 20 and clutch assembly 150. Clutch assembly 150 may be mounted around a vacuum pump shaft 112. Rotation of drive shaft 20 causes drive belt 140 to drive clutch assembly 150.

Clutch assembly 150 may include an electromagnetic clutch that selectively engages with shaft 112. When clutch assembly 150 is energized and closed, drive belt 140 synchronously rotates shaft 112 with drive shaft 20 of centrifugal pump 10, causing vacuum pump 110 to draw suction. When clutch assembly 150 is deenergized and open, the rotation of drive shaft 20 and drive belt 140 will not move shaft 112, and vacuum pump 110 will not draw suction.

Pressure sensor 130 may be mounted to a port in volute 30 and measure discharge pressure through volute 30. According to one implementation, pressure sensor 130 may be mounted at an upper portion or high point of volute 30. The mounting location may include a tapped mounting hole in volute 30, for example. Although shown in the figures at a top of volute 30, in other implementations, pressure sensor 130 may be located at a different portion of centrifugal pump 10. Pressure sensor 130 may be configured to provide a signal (e.g., via wire harness 170) to clutch assembly 150. Pressure sensor 130 may include, for example, a pressure switch configured to turn from an "off" state to an "on" state when the discharge pressure exceeds a particular pressure. According to one implementation, pressure sensor 130 may also include a wired interface to send data to a monitoring device (e.g., monitoring device 180 and wire 182, FIG. 7).

Pressure sensor 130 may detect a discharge pressure, such as would be indicative of whether or not impellers in the volute 30 casing are pushing out fluid through discharge port 34. For example, pressure sensor 130 may detect when the discharge pressure reaches a threshold and may provide a signal (e.g., via wire harness 170) to activate or deactivate clutch 150. In one implementation, pressure sensor 130 may include a pressure switch configured for a selected pressure threshold and in direct communication with the electromagnetic clutch 150. According to an implementation, the pressure threshold may be configured to reflect a primed state (e.g., a state where the main pump does not have to rely on auxiliary suction to draw liquid into volute 30) for centrifugal pump 10, but at a pressure significantly below the operating discharge pressure of centrifugal pump 10. The pressure threshold may, thus, reduce unnecessary cycling of vacuum pump 110.

In one implementation, pressure sensor 130 may indicate a primed state when the measured discharge pressure in volute 30 is at least 10 percent, and less than 50 percent, of a normal operating discharge pressure. For example, the threshold of pressure sensor 130 may be set at a value that is approximately 20% of a normal operating discharge pressure of centrifugal pump 10. Thus, for a centrifugal pump 10 with an operating discharge pressure range of 10-15 pounds per square inch (psi), the threshold for pressure sensor 130 could be set at 2 psi. The pressure threshold setting may avoid use of a controller, event detection algorithms, and/or hysteresis settings to indicate a primed or unprimed state. It should be understood that other pressure thresholds may be used in other implementations.

Pressure sensor 130 and clutch assembly 150 may operate independently of float valve 162. For example, if pressure sensor 130 detects that a pressure threshold (e.g., 2 psi) is exceeded, smart vacuum priming system 100 will disengage clutch assembly 150 regardless of the status of float valve 162. Thus, smart vacuum priming system 100 may prevent suction of liquid from float box 160 into suction assembly 120 in the event of a failure at float valve 162. In another implementation, pressure sensor 130 and clutch assembly 150 be used exclusively and float valve 162 may be eliminated.

Figure 4:
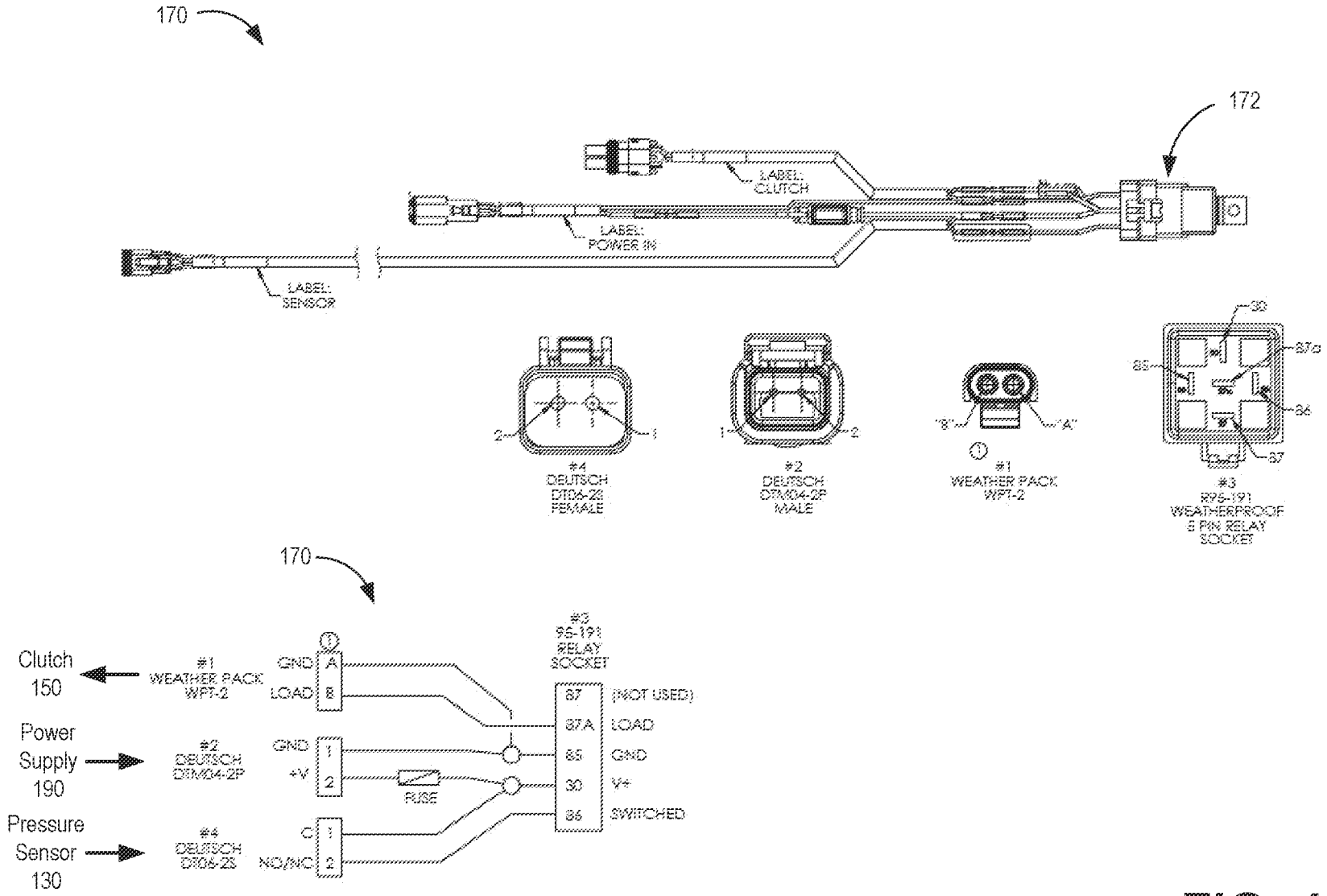
FIG. 4 is a diagram of the wire harness for the smart vacuum priming system, according to an implementation.

FIG. 4 is a diagram of wire harness 170 for smart vacuum priming system 100. Wire harness 170 may connect pressure sensor 130, clutch assembly 150, and a power supply 190 for smart vacuum priming system 100. Wire harness 170 may include a relay 172 to engage/disengage clutch assembly 150 in response to signals from pressure sensor 130. In one implementation, wire harness 170 may include a 50 Amp, 12 volt (V) direct current (DC) relay. According to one aspect, wire harness 170 further includes a connection for independently powering the electromagnetic clutch 150, separate from signals by pressure sensor 130. Thus, in the event of a pressure sensor failure, for example, smart vacuum priming system 100 may be manually connected to the pump power source to energized/close clutch assembly 150 for priming. In another implementation, wire harness 170 may also include a wired connection to indicate to a monitoring device (e.g., monitoring device 180) the state (e.g., energized/deenergized) of clutch assembly 150.

Figure 5B:
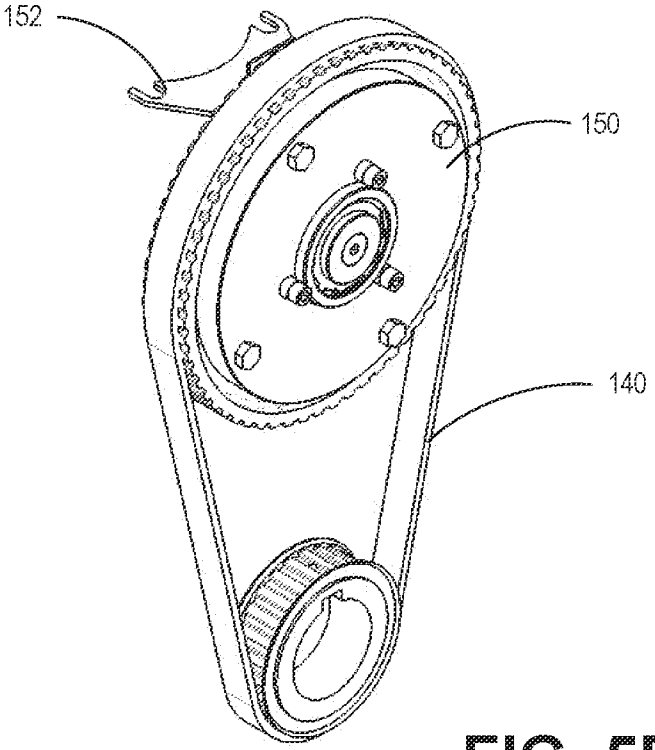
FIGS. 5A and 5B are rear and front perspective views of the clutch assembly for the smart vacuum priming system.
Figure 5A:
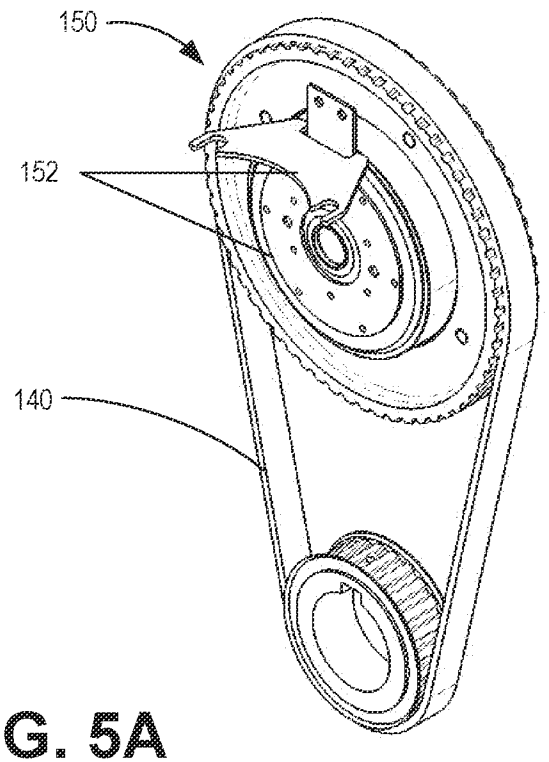

FIGS. 5A and 5B are rear and front perspective views of clutch assembly 150 of smart vacuum priming system 100. Clutch assembly 150 may be mounted over a vacuum pump shaft 112 that is aligned substantially parallel to main pump shaft 20. An L-shaped mounting bracket 152 is configured to support clutch assembly 150 in a plane oriented orthogonal to vacuum pump shaft 112. As installed in configurations shown herein, mounting bracket 152 may include a vertical component, secured to clutch assembly 150, with a through-hole for vacuum pump shaft 112. Mounting bracket 152 may also include a horizontal component, secured to a housing of vacuum pump 110. The horizontal component may include bolt holes and a curved surface to accommodate a vertical cylindrical portion of the vacuum pump housing housing (FIG. 2). The curved surface may have a radius substantially equal to the radius of the vertical cylindrical portion of the vacuum pump housing. Thus, mounting bracket 152 may be mounted/bolted to a horizontal surface and orient an axis 154 of clutch assembly 150 parallel to an axis 24 of drive shaft 20.

Figure 6:
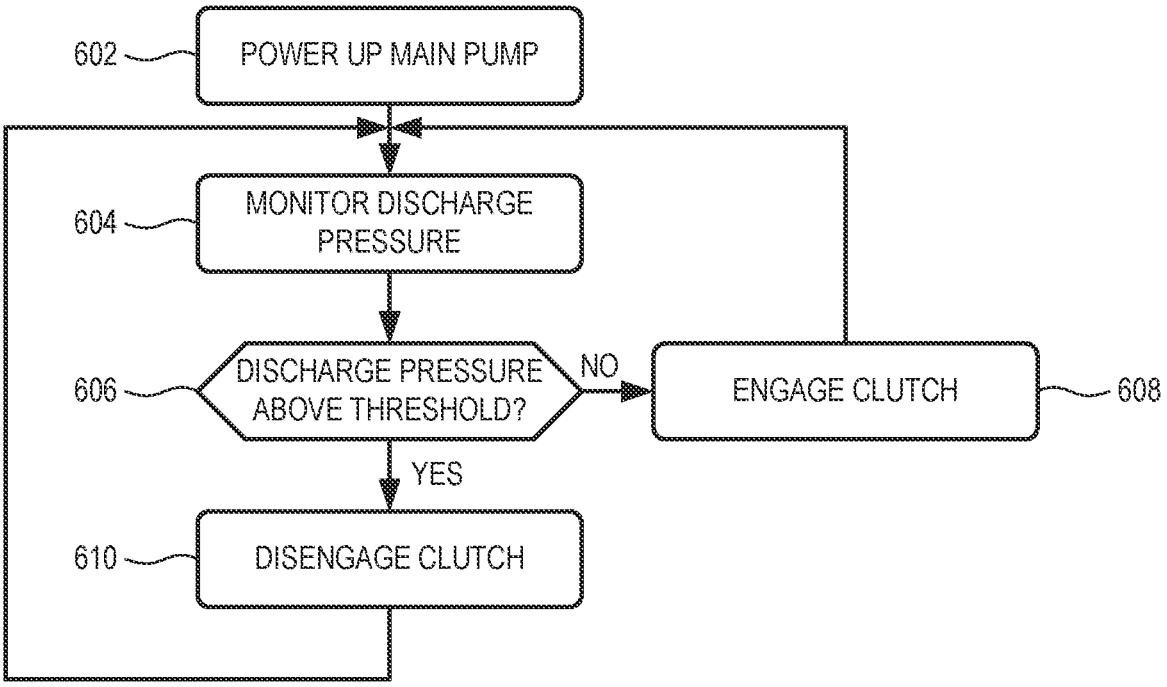
FIG. 6 is a flow diagram illustrating control logic for the smart vacuum priming system, according to an implementation.

FIG. 6 is a flow diagram illustrating simplified operating logic for smart vacuum priming system 100. As shown in FIG. 6, at block 602, a pump 10 with smart vacuum priming system 100 may be powered up. Upon receiving power (via wire harness 170), pressure sensor 130 will monitor discharge pressure in volute 30, as indicated at block 604.

If the discharge pressure is not above a set threshold (block 606-"No"), clutch assembly 150 may be engaged (block 608). For example, during initial operation of pump 10, volute 30 may be dry and, thus, pressure sensor 130 would detect little or no discharge pressure. Based on a low pressure reading (e.g., below threshold) from pressure sensor 130, clutch assembly 150 would engage and cause belt 140 to drive vacuum pump 110.

If the discharge pressure is above a set threshold (block 606-"Yes"), clutch assembly 150 may be disengaged (block 610). For example, after a short period of operation, vacuum pump 110 may prime centrifugal pump 10, and pump 10 may begin to expel liquid out discharge port 34. Pressure sensor 130 would detect discharge pressure rising above the threshold, and clutch assembly 150 would disengage belt 140 from driving vacuum pump 110.

Pressure sensor 130/clutch assembly 150 operate independently of float valve 162 to prevent suction of liquid from float box 160 in the event of a float valve failure. Smart vacuum priming system 100 may continue to monitor pressure and recursively couple or decouple vacuum pump 110 to the drive shaft 20 until, for example, main pump 10 is powered off.

Figure 7:
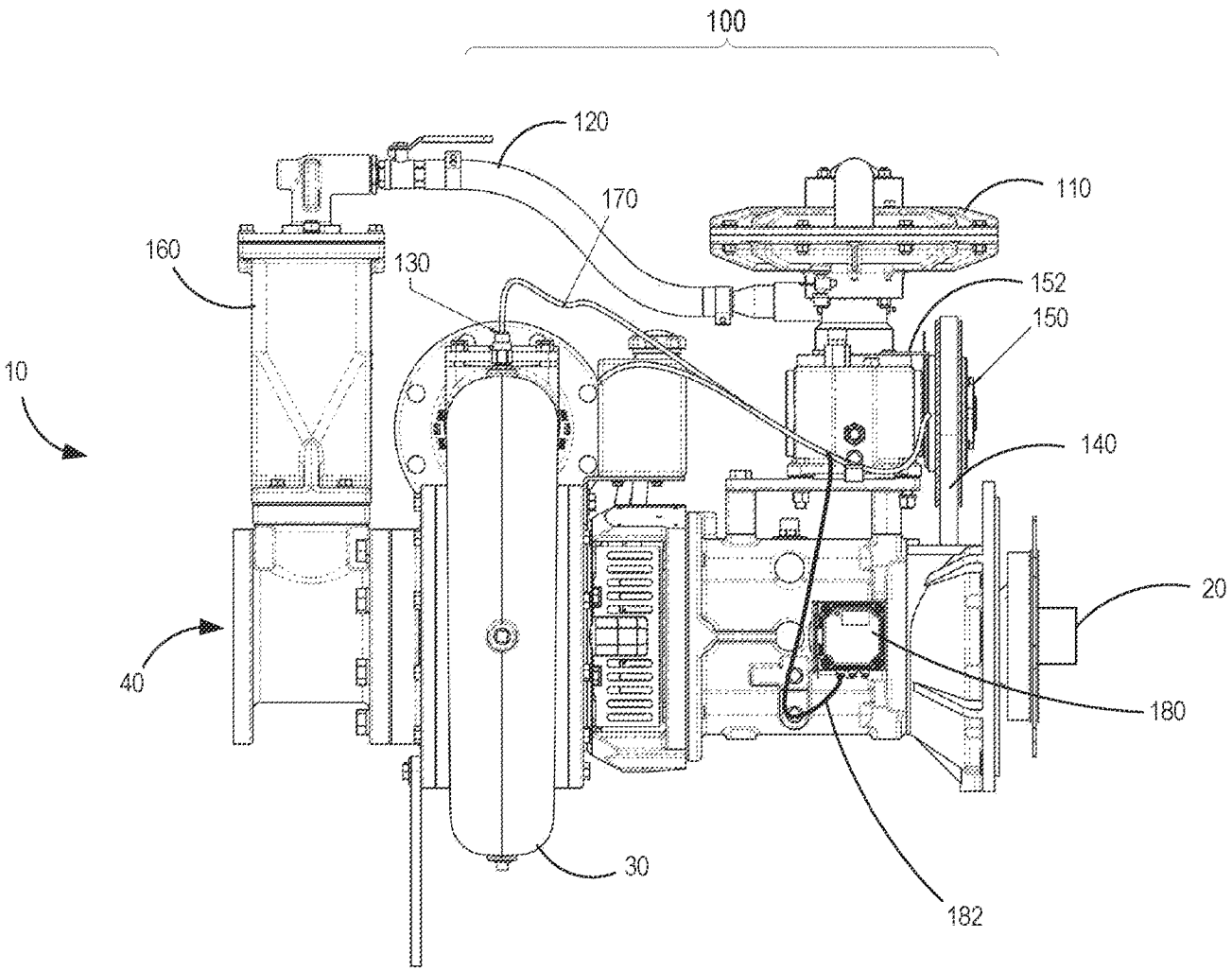
FIG. 7 is a side view of pump assembly including a smart vacuum priming system, according to another implementation described herein.

FIG. 7 is a side view of a pump 10 including a smart vacuum priming system 100 and an integrated monitoring device 180, according to another implementation. As further shown in FIG. 7, for example, a monitoring device 180 may be mounted to centrifugal pump 10 (e.g., mounted to the bearing frame). Monitoring device 180 may include a housing configured for physical attachment, as a single unit, to a mounting surface on the outside of centrifugal pump 10. Monitoring device 180 may include an Internet of Things device (e.g., an IoT device, such as an industrial IoT device), a Machine Type Communication (MTC) device, a machine-to-machine (M2M) device, an enhanced MTC device (eMTC) (also known as Cat-M1), an end node employing Low Power Wide Area (LPWA) technology such as Narrow Band (NB) IoT (NB-IoT) technology, or some other type of wireless end node. According to various exemplary embodiments described further herein, monitoring device 180 may include hardware, such as a processor, microprocessor, application-specific integrated circuit (ASIC), a field-programmable gate array (FPGA), or a combination of hardware and software (e.g., a processor executing software) to execute various types of functions.

Monitoring device 180 may be a multipurpose device including calibrated sensors to collect vibration, temperature, and/or other pump data, and forward the collected data via a wireless interface for access by users. As described further herein, monitoring device 180 may also include a port to receive, via wired connection 182, signals from pressure sensor 130 and/or wiring harness 170 to indicate a state (e.g., energized/deenergized) of clutch assembly 150. For example, the clutch assembly state may be determined indirectly from pressure sensor threshold signals or directly from clutch relay signals.

Monitoring device 180 may receive pressure data from pressure sensor 130 or state data from clutch assembly 150. For example, monitoring device 130 may receive signals whenever pressure sensor 130 detects a threshold is crossed or whenever clutch assembly 150 changes state to engage/disengage vacuum pump 110. According to one implementation, monitoring device 180 may be configured to temporarily store, upload, and/or and generate alert signals based on data from smart vacuum priming system 100. The state of clutch assembly 150 may be collected by monitoring device 180, for example, to identify cycling patterns for smart vacuum priming system 100, vacuum pump 110 service hours, etc.

Figure 8:
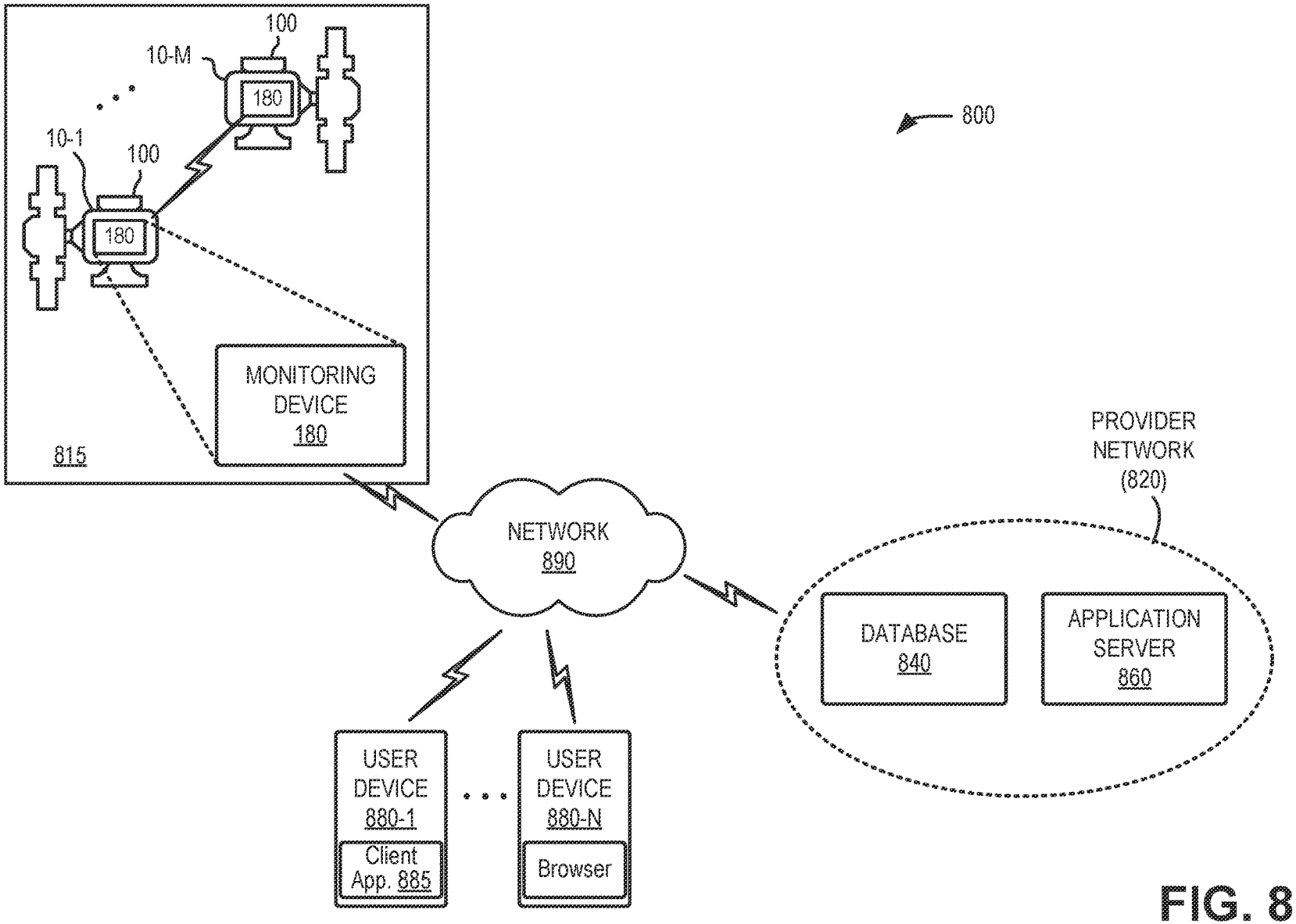
FIG. 8 is a simplified diagram of a network environment in which systems and methods described herein may be implemented.

FIG. 8 is a diagram illustrating an exemplary environment 800 in which systems and/or methods described herein may be implemented. As illustrated, environment 800 may include centrifugal pumps 10-1 through 10-M (collectively and individually referred to herein as "pump 10"). Each of pumps 10 may be configured with a smart vacuum priming system 100 and a monitoring device 180. Pumps 10 may be distributed/provided throughout customer premises 815, such as an industrial, commercial, educational, or agricultural environment, for example. Environment 800 may also include a provider network 820, with a database 840 and an application server 860, and user devices 880-1 through 880-N interconnected by a network 890. Components of environment 800 may be connected via wired and/or wireless links.

Provider network 820 may include network devices, computing devices, and other equipment to provide services, including services for customers with monitoring devices 180. For example, devices in provider network 820 may supply backend services to user devices 880 for remotely monitoring pump equipment 100. Provider network 820 may include, for example, one or more private Internet Protocol (IP) networks that use a private IP address space. Provider network 820 may include a local area network (LAN), an intranet, a private wide area network (WAN), etc. According to an implementation, provider network 820 may use vendor-specific protocols to support IoT management. In another implementation, provider network 820 may include a hosting platform that provides an IoT data service. The IoT data service may include receiving packets that are transmitted by monitoring devices 180 and implementing models to collect, store, analyze, and/or present event data from monitoring devices 180. The hosting platform may also provide data-driven applications and/or analytics services for user devices 880 that owners of monitoring devices 180 may use. Although shown as a single element in FIG. 8, provider network 820 may include a number of separate networks.

Database 840 may include one or more databases or other data structures to store data uploads from monitoring devices 180, reporting/monitoring configurations, device registrations (e.g., provided by user devices 880 via client applications 885) and/or user registrations.

Application server 860 may include one or more network or computational devices to perform services for smart vacuum priming system 100. According to an implementation, application server 860 may use a series of application programming interfaces (APIs) to receive data from monitoring devices 180. For example, monitoring device 180 may forward to application server 860 periodic uploads of cycling patterns or service time for smart vacuum priming system 100. In other aspects, monitoring device 180 may forward to application server 860 real-time alerts for excessive clutch cycling or failure to disengage in a timely manner. Application server 860 may store historical data records from smart vacuum priming system 100 in database 840. Application server 860 may also report alerts to registered users (e.g., at user devices 880).

User device 880 includes a device that has computational and wireless communication capabilities. User device 880 may be implemented as a mobile device, a portable device, a stationary device, a device operated by a user, or a device not operated by a user. For example, user device 880 may be implemented as a smartphone, a computer, a tablet, a wearable device, or some other type of wireless or wired device. According to various exemplary embodiments, user device 880 may be configured to execute various types of software (e.g., applications, programs, etc.). As described further herein, user device 880 may download and/or register a client application 885. As described further herein, the client application 885 (or "app") may be designed to access, from provider network 820, data reported by monitoring devices 180. For example, client application 885 may provide a user interface (UI) to solicit configuration settings and data requests from a user.

Network 890 may include one or more wired, wireless and/or optical networks that are capable of receiving and transmitting data, voice and/or video signals. For example, network 890 may include one or more access networks, IP multimedia subsystem (IMS) networks, core networks, or other networks. The access network may include one or more wireless networks and may include a number of transmission towers for receiving wireless signals and forwarding wireless signals toward the intended destinations. The access network may include a wireless communications network that connects subscribers (e.g., monitoring devices 180, user devices 880, etc.) to other portions of network 890 (e.g., the core network). In one example, the access network may include a long-term evolution (LTE) network. In other implementations, the access network may employ other cellular broadband network standards such as 3rd Generation Partnership Project (3GPP) Fifth Generation (5G) and future standards. Network 890 may further include one or more satellite networks, one or more packet switched networks, such as an IP-based network, a local area network (LAN), a wide area network (WAN), a personal area network (PAN) (e.g., a wireless PAN), a wireless local area network (WLAN), an intranet, the Internet, or another type of network that is capable of transmitting data.

In FIG. 8, the particular arrangement and number of components of environment 800 are illustrated for simplicity. In practice there may be more monitoring devices 180, provider networks 820, databases 840, application servers 860, user devices 880, and/or networks 890.

The smart vacuum priming system described herein is more energy efficient and provides for greater component service life than a conventional tie-in vacuum system (e.g., that runs off the same shaft that runs the main pump). Running the vacuum pump in the traditional tie-in set up would draw additional power (e.g., a continuous draw to power a 0.5 to 2 horsepower (HP) pump). The system and methods described herein reduce the power required and only draw power during priming, reducing power consumption and component wear over the lifetime of the pump system and improving efficiency.

Use of discharge pressure thresholds as an approximation of a primed state provides for consistent state indications to avoid excessive clutch cycling. Because the smart vacuum priming system is not tied to float valve operations, the system can protect vacuum pump components in the event of a float valve failure or leakage. While a separate power supply can be used for normal operation, the smart vacuum priming system is configured to be able to use the same power source that is used by the main pump motor, if needed. The smart vacuum priming system is thus, well suited for use with engine-mounted portable pumps. Furthermore, the smart vacuum priming system can be connected to a frame-mounted monitoring device provide for data collection and remote monitoring capabilities.

The foregoing description of embodiments provides illustration, but is not intended to be exhaustive or to limit the embodiments to the precise form disclosed. Accordingly, modifications to the embodiments described herein may be possible. For example, various modifications and changes may be made thereto, and additional embodiments may be implemented, without departing from the broader scope of the invention as set forth in the claims that follow. The description and drawings are accordingly to be regarded as illustrative rather than restrictive.

As set forth in this description and illustrated by the drawings, reference is made to "an exemplary embodiment," "an embodiment," "embodiments," etc., which may include a particular feature, structure or characteristic in connection with an embodiment(s). However, the use of the phrase or term "an embodiment," "embodiments," etc., in various places in the specification does not necessarily refer to all embodiments described, nor does it necessarily refer to the same embodiment, nor are separate or alternative embodiments necessarily mutually exclusive of other embodiment(s). The same applies to the term "implementation," "implementations," etc.

The terms "a," "an," and "the" are intended to be interpreted to include one or more items. Further, the phrase "based on" is intended to be interpreted as "based, at least in part, on," unless explicitly stated otherwise. The term "and/or" is intended to be interpreted to include any and all combinations of one or more of the associated items. The word "exemplary" is used herein to mean "serving as an example." Any embodiment or implementation described as "exemplary" is not necessarily to be construed as preferred or advantageous over other embodiments or implementations.

Use of ordinal terms such as "first," "second," "third," etc., in the claims to modify a claim element does not by itself connote any priority, precedence, or order of one claim element over another, the temporal order in which acts of a method are performed, the temporal order in which instructions executed by a device are performed, etc., but are used merely as labels to distinguish one claim element having a certain name from another element having a same name (but for use of the ordinal term) to distinguish the claim elements.

No element, act, or instruction used in the description of the present application should be construed as critical or essential to the invention unless explicitly described as such.

What is claimed is:

1. A vacuum priming system for a main pump, the system comprising:

a vacuum pump;

a suction assembly providing fluid communication between the vacuum pump and a float box of the main pump;

an electromagnetic clutch assembly configured to selectively run the vacuum pump, wherein main pump powers the vacuum pump when the electromagnetic clutch assembly is engaged;

a pressure sensor configured to indicate, based on a discharge pressure in a volute of the main pump, when the main pump is in a primed state; and a wire harness configured to connect the pressure sensor, the electromagnetic clutch assembly, and a power source, wherein, when the pressure sensor indicates the main pump is in the primed state, the electromagnetic clutch assembly decouples the vacuum pump from a drive shaft of the main pump; and wherein, when the pressure sensor indicates the main pump is not in the primed state, the electromagnetic clutch assembly couples the vacuum pump to the drive shaft.

2. The system of claim 1, further comprising:

a float valve in the float box, wherein the float valve blocks suction from the suction assembly based on a fluid level in the float box, and wherein the float valve operates independently of the pressure sensor and electromagnetic clutch assembly.

3. The system of claim 1, further comprising:

a belt configured to supply power from the drive shaft of the main pump to the vacuum pump, wherein the electromagnetic clutch assembly is configured to couple and decouple the belt from the vacuum pump.

4. The system of claim 1, wherein the wire harness further includes a wired connection to indicate to a monitoring device the state of electromagnetic clutch assembly.

5. The system of claim 1, wherein the wire harness further comprises a connection for powering the electromagnetic clutch assembly from a direct current (DC) power source.

6. The system of claim 1, wherein the pressure sensor indicates the primed state when the measured discharge pressure in the volute is at least 10 percent, and less than 50 percent, of a normal operating discharge pressure of the main pump.

7. The system of claim 1, wherein the pressure sensor is a pressure switch.

8. The system of claim 1, wherein the pressure sensor is affixed at a top of the volute.

9. The system of claim 1, further comprising:

an L-shaped mounting bracket configured to support the electromagnetic clutch assembly in a plane oriented orthogonal to a shaft of the vacuum pump.

10. The system of claim 1, further comprising:

a communication interface configured to connect a relay for the electromagnetic clutch assembly to a monitoring device, wherein the monitoring device is configured to collect and provide clutch state data.

11. A centrifugal pump, comprising:

a volute housing an impeller;

a drive shaft for the impeller;

a float box;

a priming system including:

a vacuum pump, a suction assembly providing fluid communication between the vacuum pump and the float box, an electromagnetic clutch assembly configured to selectively run the vacuum pump, wherein the drive shaft powers the vacuum pump when the electromagnetic clutch assembly is engaged, and a pressure sensor configured to indicate, based on a discharge pressure in the volute, when the centrifugal pump is in a primed state; and an L-shaped mounting bracket configured to support the electromagnetic clutch assembly in a plane oriented orthogonal to a shaft of the vacuum pump, wherein, when the pressure sensor indicates the centrifugal pump is in the primed state, the electromagnetic clutch assembly decouples the vacuum pump from the drive shaft to prevent suction through the suction assembly, and wherein, when the pressure sensor indicates the centrifugal pump is not in the primed state, the electromagnetic clutch assembly couples the vacuum pump to the drive shaft to permit suction through the suction assembly.

12. The centrifugal pump of claim 11, further comprising:

a float valve in the float box, wherein the float valve blocks suction from the suction assembly based on a fluid level in the float box, and wherein the float valve operates independently of the pressure sensor and electromagnetic clutch assembly.

13. The centrifugal pump of claim 11, further comprising:

a belt configured to supply power from the drive shaft to the vacuum pump, wherein the electromagnetic clutch assembly is configured to couple and decouple the belt from the vacuum pump.

14. The centrifugal pump of claim 11, further comprising:

a wire harness configured to connect the pressure sensor, the electromagnetic clutch assembly, and a power source.

15. The centrifugal pump of claim 11, wherein the pressure sensor indicates the primed state when the measured discharge pressure in the volute is at least 10 percent, and less than 50 percent, of a normal operating discharge pressure of the centrifugal pump.

16. The centrifugal pump of claim 11, further comprising:

a communication interface configured to connect a relay for the electromagnetic clutch assembly to a monitoring device, wherein the monitoring device is configured to collect and provide clutch state data.

17. The centrifugal pump of claim 11, wherein the vacuum pump is mounted to a housing of the centrifugal pump.

18. The centrifugal pump of claim 11, wherein the pressure sensor includes a pressure switch in direct communication with the electromagnetic clutch assembly.

19. A vacuum priming system for a main pump, the system comprising:

a vacuum pump;

a suction assembly providing fluid communication between the vacuum pump and a float box of the main pump;

an electromagnetic clutch assembly configured to selectively run the vacuum pump, wherein main pump powers the vacuum pump when the electromagnetic clutch assembly is engaged;

a pressure sensor configured to indicate, based on a discharge pressure in a volute of the main pump, when the main pump is in a primed state; and a communication interface configured to connect a relay for the electromagnetic clutch assembly to a monitoring device that is configured to collect and provide clutch state data, wherein, when the pressure sensor indicates the main pump is in the primed state, the electromagnetic clutch assembly decouples the vacuum pump from a drive shaft of the main pump; and wherein, when the pressure sensor indicates the main pump is not in the primed state, the electromagnetic clutch assembly couples the vacuum pump to the drive shaft.

20. The system of claim 19, further comprising:

a wire harness configured to connect the pressure sensor, the electromagnetic clutch assembly, and a power source.

* * * * *